US005330323A

United States Patent [19]

Swanson

[11] Patent Number: 5,330,323

[45] Date of Patent: Jul. 19, 1994

[54] CEILING FAN

[75] Inventor: Dennis K. Swanson, Woodland Hills, Calif.

[73] Assignee: Lamps Plus, Inc., Chatsworth, Calif.

[21] Appl. No.: 988,054

[22] Filed: Jan. 19, 1993

[51] Int. Cl.[5] ..... F04D 29/34

[52] U.S. Cl. ..... 416/219 A; 416/5; 416/204 R; 416/210 R

[58] Field of Search ..... 416/5, 170 C, 204 R, 416/210 R, 219 A, 220 A; D23/411, 413

[56] References Cited

U.S. PATENT DOCUMENTS

D. 263,498 3/1982 Markowitz ..... D23/411
D. 271,134 10/1983 Yung ..... D23/411
D. 328,951 8/1992 Scofield et al. ..... D23/411
1,514,246 11/1924 Assala ..... 416/220 A
5,151,011 9/1992 Rezek ..... 416/5

*Primary Examiner*—Edward K. Look
*Assistant Examiner*—James A. Larson
*Attorney, Agent, or Firm*—Robbins, Berliner & Carson

[57] ABSTRACT

A ceiling fan having a plurality of blade irons removably attached to a rotor. Each blade iron includes an arcuate web with a first flange for attachment to the rotor. A second flange is included for receiving a fan blade. The trailing edge of each blade iron overlaps the leading edge of the next successive blade iron.

11 Claims, 4 Drawing Sheets

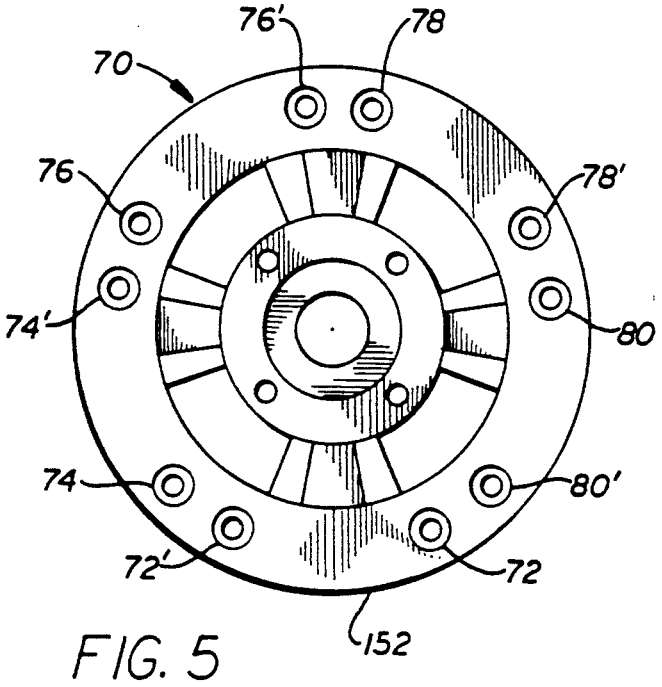
FIG. 5
FIG. 6
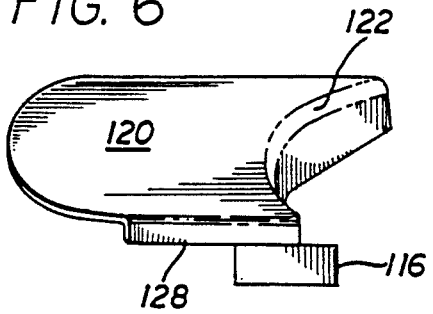
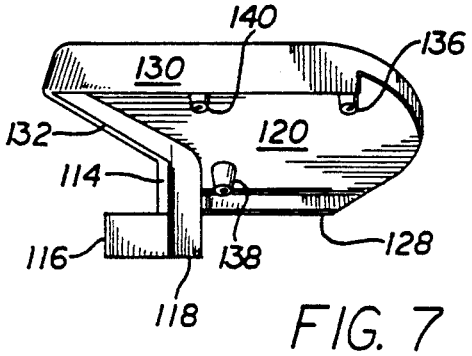
FIG. 7
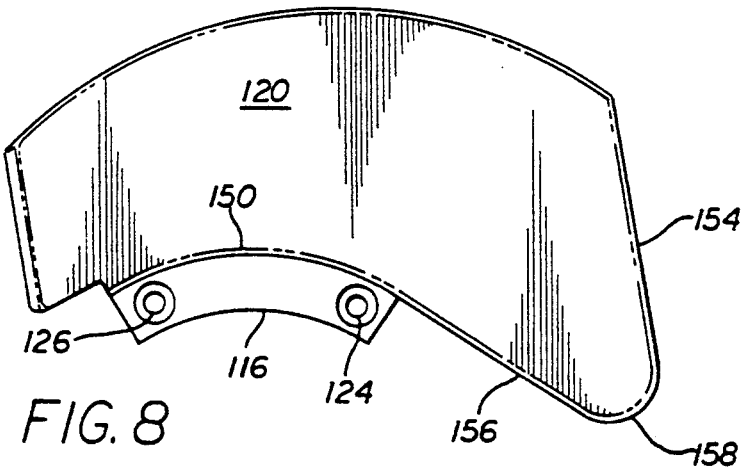
FIG. 8
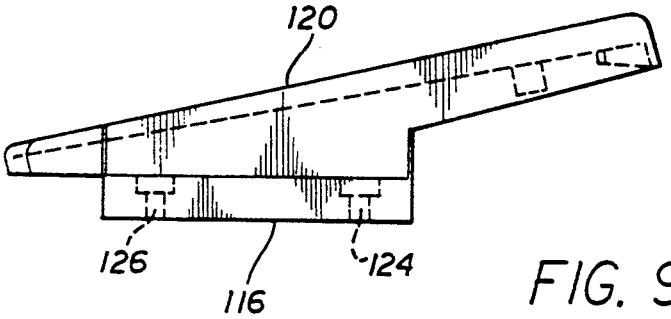
FIG. 9

CEILING FAN

BACKGROUND OF THE INVENTION

The present invention relates generally to fans and more specifically to electrically operated ceiling fans of the type normally used in homes or businesses to create a circulation of air within a room or other confined space.

Ceiling fans have been known for a long period of time. Such fans typically are used during the summer months to move air from the ceiling toward the floor of a space to enhance air conditioning systems thereby requiring less cooling of the ambient air in order to maintain comfort. Such fans may be operated in a reverse direction to move air from the floor toward the ceiling. Such operational format is normally utilized during the winter months to move heated air away from the ceiling and back toward the floor of an enclosed space to thereby create a situation where less heat is required to maintain the particular space comfortable for the occupants.

Throughout the remainder of this Application, the terms "trailing edge" and "leading edge" may be utilized from time to time when describing certain features of the ceiling fan constructed in accordance with the principles of the present invention. When so utilized, those terms will be used with respect to the rotation of the fan as it is normally used in the summer months to move air from the ceiling toward the floor as it rotates. That is, air is moving downwardly directly beneath the fan blades as they rotate.

Prior art fans known to Applicant typically are constructed utilizing blade irons which are affixed at the inner periphery thereof to a rotor which is turned by a motor when it is electrically energized. The blade irons include an arm extending outwardly to which the blade of the fan is affixed. Typically the entire fan blade is exposed to view when viewed from below. Typically such prior art fan blades are narrow at the blade root and converge outwardly so that the blade tip is wider than the blade root.

Recent ceiling fans have been constructed in such a way that the rotor is completely enclosed and the roots of the fan blades appear to extend through such enclosure. This tends to provide an appearance of an integrated swept wing design to the fan. Such design provides a more streamlined appearance, including an appearance where the taper of the fan blade is reversed from that normally encountered in that the root is wider than the tip. This new design presents complex shapes and configurations which are expensive to manufacture and wherein maintenance is difficult and therefore costly, particularly where the fan blade must be removed.

It is therefore desirable to provide a ceiling fan which produces the swept wing design but which is relatively simple to manufacture and assemble and to also provide the ability to convert currently existing fans to such new swept wing design.

SUMMARY OF THE INVENTION

A ceiling fan including a motor having a rotor with a plurality of blade irons removably attached thereto, each of the blade irons having a fan blade removably attached thereto with each blade iron having an arcuate web with a first flange extending inwardly from the web for attachment to the rotor and a second flange extending outwardly from the web to receive the fan blade with the trailing edge of each blade iron radially overlapping the leading edge of the next successive blade iron.

BRIEF DESCRIPTION OF THE DRAWINGS

FIG. 5 is a bottom view of a rotor connected to a fan motor;

FIG. 6 is a left side view of a blade iron constructed in accordance with the principles of the present invention;

FIG. 7 is a right side view of the blade iron of FIG. 6;

FIG. 8 is a bottom view of the blade iron of FIG. 6;

FIG. 9 is a front view of the blade iron of FIG. 6; and

DETAILED DESCRIPTION

The ceiling fan of the present invention is constructed from components which may be easily and readily assembled and which may be used for conversion of presently installed ceiling fans to a more contemporary swept wing design appearance. The fan blades utilized are tapered so that the outer edges thereof converge outwardly.

Figure 1:
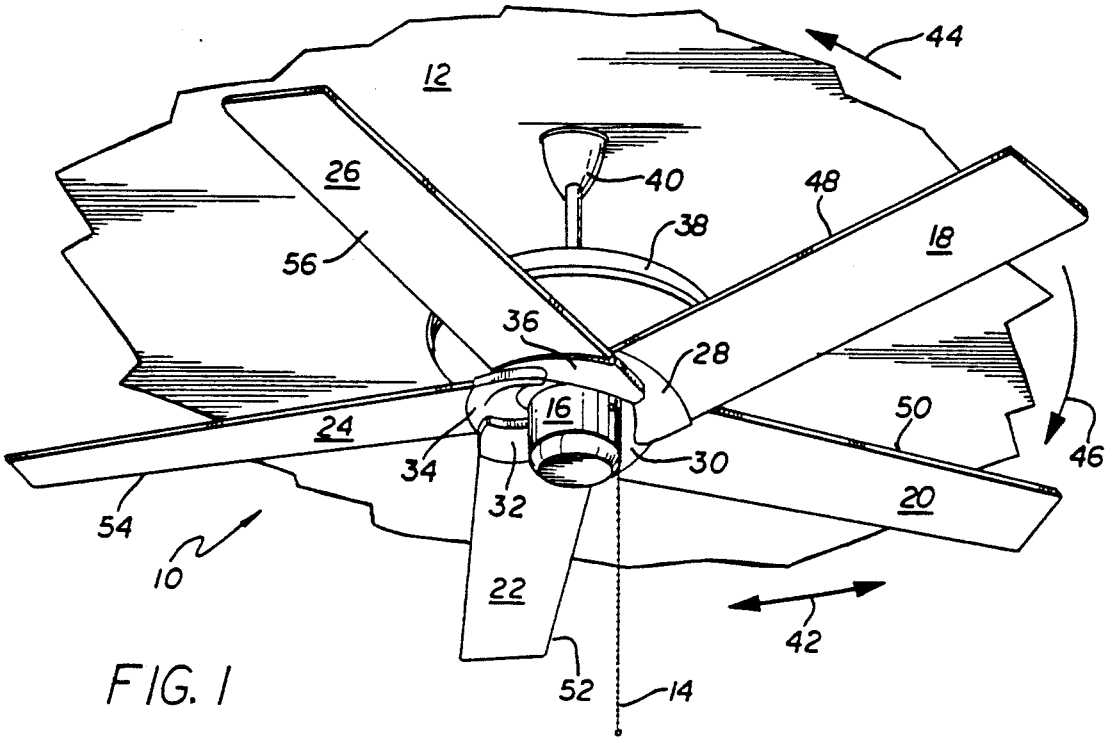
FIG. 1 is a perspective view illustrating a ceiling fan constructed in accordance with the principles of the present invention installed beneath a ceiling.
Figure 2:
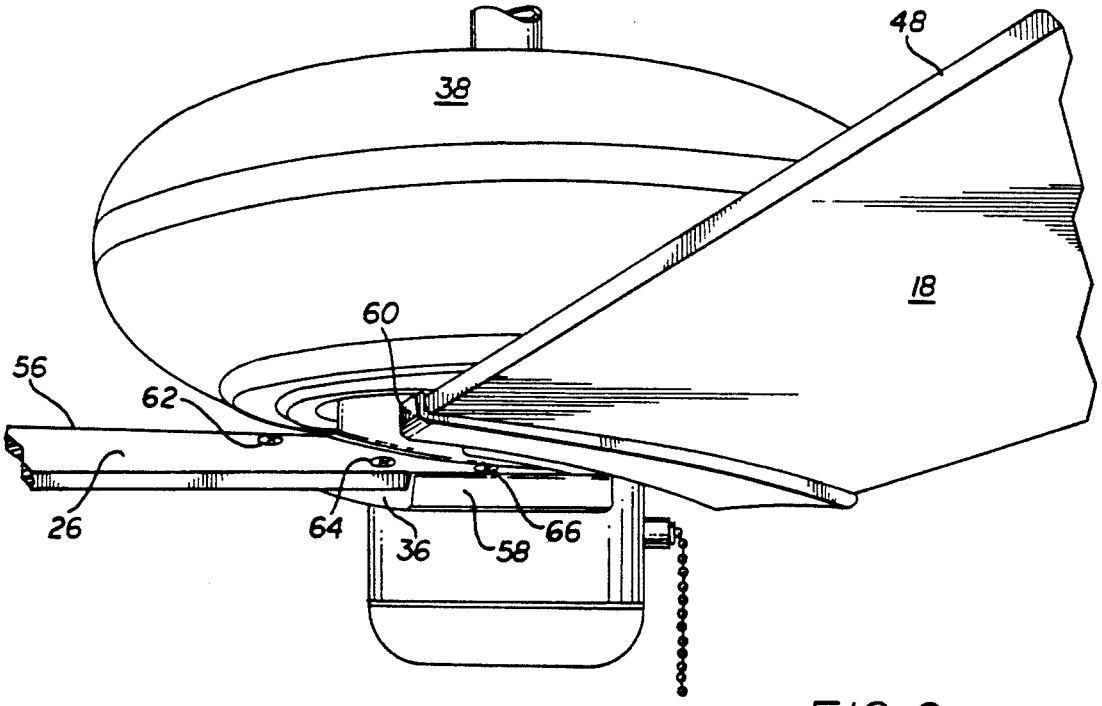
FIG. 2 is a fragmented perspective view illustrating a pair of blade irons having fan blades attached thereto.

A ceiling fan constructed in accordance with the principles of the present invention is shown in FIGS. 1 and 2 to which reference is hereby made. As is therein shown, the ceiling fan 10 is affixed to a ceiling 12 within a residence, office or other similar enclosed space. An on/off control such as a pull chain 14 is utilized to activate a lamp 16 as well as the fan 10. The fan 10 and/or the light 16 may also be controlled from a wall switch or from a remote control unit as is well known to those skilled in the art. The pull chain 14 is illustrated merely for purposes of showing that the fan and light may be turned off and on as desired. A plurality of fan blades 18–26 (in this instance 5) are affixed to blade irons 28–36. The blade irons in turn are affixed to a rotor (not shown) which is disposed within a housing 38 which in turn is supported by an appropriate fixture 40 to the ceiling 12.

The fan typically may be operated to rotate in either direction as is shown by the double-headed arrow 42 depending upon whether the fan is being used in winter or summer. During the summer months the fan is operated by rotating in a counter-clockwise direction as shown by the solid arrow 44, while in the winter months it is operated in a clockwise direction as shown by the arrow 46. The counter-clockwise direction moves air downwardly as the fan rotates to move the cooler air within the enclosed space and to effectively provide a wind chill so that less cooling of the air by an air conditioning system is required to create ambient air which is more comfortable to the occupants of the space. It is during this operation that the edges 48–56 of the fan blades 18–26, respectively, are the leading edges while the opposite edges are the trailing edges. The same terminology will be utilized with respect to the blade irons 28–36.

As is seen more readily in FIG. 2, the trailing edge 58 of the blade iron 36 substantially overlaps the leading edge 60 of the blade iron 28. As is also seen in FIG. 2, the blades 18–26 are detachably affixed to the blade irons 28–36 as by fasteners such as bolts 62–66 which attach the blade 26 to the blade iron 36. It will also be noted by viewing FIGS. 1 and 2 that the bottom surface (when viewed from beneath the fan) of the blade irons is smooth and unobstructed. It will also be noted that the trailing edge of each of the blade irons is substantially wider than is the leading edge thereof. Such can be particularly noted when comparing the leading edge 60 of the blade iron 28 to the trailing edge 58 of the blade iron 36 as seen in FIG. 2. Such construction along with the smooth bottom surfaces of the blade irons provides a swept wing appearance to the ceiling fan.

Figure 3:
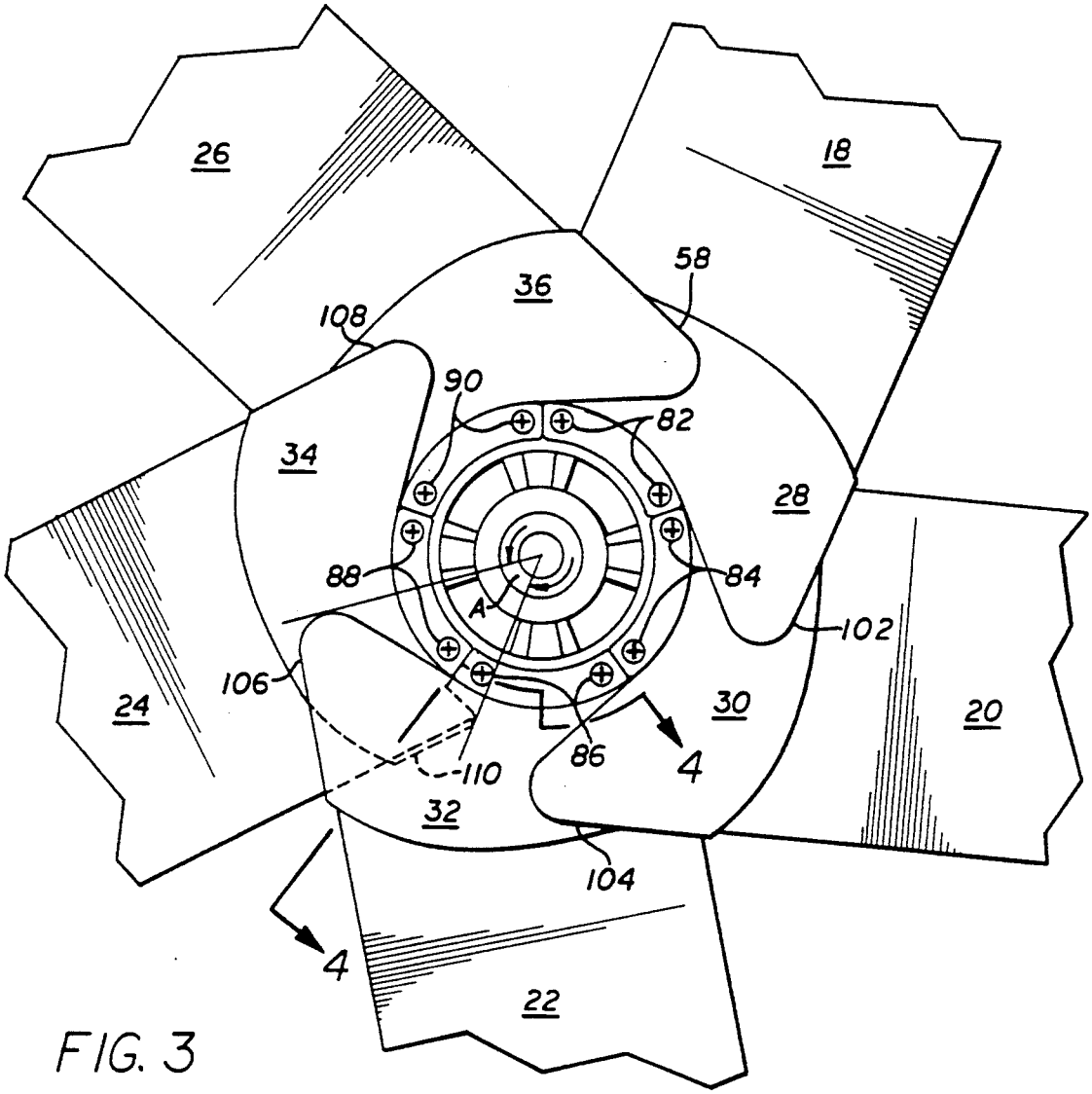
FIG. 3 is a bottom view of the fans shown in FIG. 1 with the light and control mechanism removed.
Figure 4:
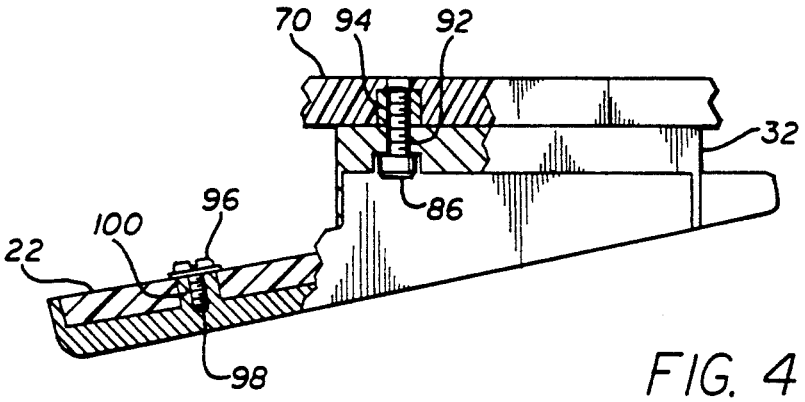
FIG. 4 is a cross-sectional view taken about the lines 4—4 of FIG. 3.

Referring now more specifically to FIGS. 3, 4, and 5, the assembly of the blades to the rotor is more clearly illustrated. As is therein shown, a rotor 70 includes a plurality of pairs of openings 72-72', 74-74', 76-77', 78-78', and 80-80'. The blade irons 28–36 are detachably affixed to the pairs of openings 72–80, respectively, as shown by the fasteners such as both pairs of bolts 82–90 (FIG. 3). AS is shown in FIG. 4, a bolt 86 passes through an opening 92 provided in the blade iron 32. The bolt is threaded into threads provided in a metallic insert 94 molded into the rotor 70 at the time it is fabricated. Typically the rotor is constructed of an appropriate plastic material as is well known to those skilled in the art. As is also shown in FIG. 4, the fan blade 22 is secured in place by the bolt 96 which is secured within threads provided within an opening 98 formed in the post 100 which is constructed as an integral part of the blade iron 32. Typically the blade irons are manufactured by casting utilizing zinc or similar material after which the posts such as 100 are drilled and tapped as is well known to those skilled in the art.

FIG. 3 provides a particularly good illustration of the manner in which the trailing edges 58 and 102–108 of the blade irons 36 and 28–34, respectively, overlap the leading edges of the next successive blade iron when considering the direction of rotation for cooling purposes. Such a leading edge is shown at 110 (in dashed lines) for the blade iron 34. It can be seen that the amount of overlap in this particular configuration is slightly greater than 45° when measured radially from the tip of the root of the leading edge 110 to the tip of the root of that trailing edge 106 as shown by the angle A. It is this overlapping configuration which provides the very pleasing swept wing appearance of the fan constructed in accordance with the principles of the present invention.

Referring now more specifically to FIG. 6–9, there is illustrated the blade iron which is constructed in accordance with the principles of the present invention. As is therein shown, the blade iron includes a web 114 having an inwardly directed flange 116 extending from one edge 118 thereof. An outwardly directed flange 120 extends from the opposite edge 122 of the web 114. The inwardly directed flange 116 defines a pair of openings 124 and 126 which mate with adjacent openings such as 72-72' in the rotor 70 to receive the bolts such as 86 to thereby removably attach the blade irons to the rotor as above described. The outwardly extending flange 120 defines an upwardly extending (as viewed in FIG. 2) rim about three sides thereof as shown at 128, 130 and 132. The rim 128–130–132 serves to capture the root 134 (FIG. 10) of the fan blade and hold it firmly in place within the flange 120 of the blade iron. As is clearly shown in FIG. 7, the flange 120 is formed as an integral part of the blade iron. The posts 136, 138 and 140 which receive the fasteners 142, 144 and 146 (FIG. 10) retain the fan blade 148 upon the blade iron. As can be seen in FIGS. 6, 7 and 9 a plane formed by the flange 120 if extended would converge with and intersect a plane formed by the flange 116 proximate the leading edge when considering the direction of rotation of the fan for the summer months as above described.

As will be seen particularly with reference to FIG. 6 and 8, the web 114 defines an arcuate surface 150 which effectively mates with the curvature of the outer surface 152 of the rotor 70 (FIG. 5). As the outwardly extending flange 120 then continues toward the trailing edge 154 thereof, the arcuate surface 150 of the web 114 fairs into a straight surface 156 formed by the rim 132. The straight surface 156 is tangential to the curved surface 150 and to the outer surface 152 of the rotor. The tangential surface ends in curved tip 158 and provides a very pleasing streamlined appearance to the trailing edge of the blade iron.

Figure 10:
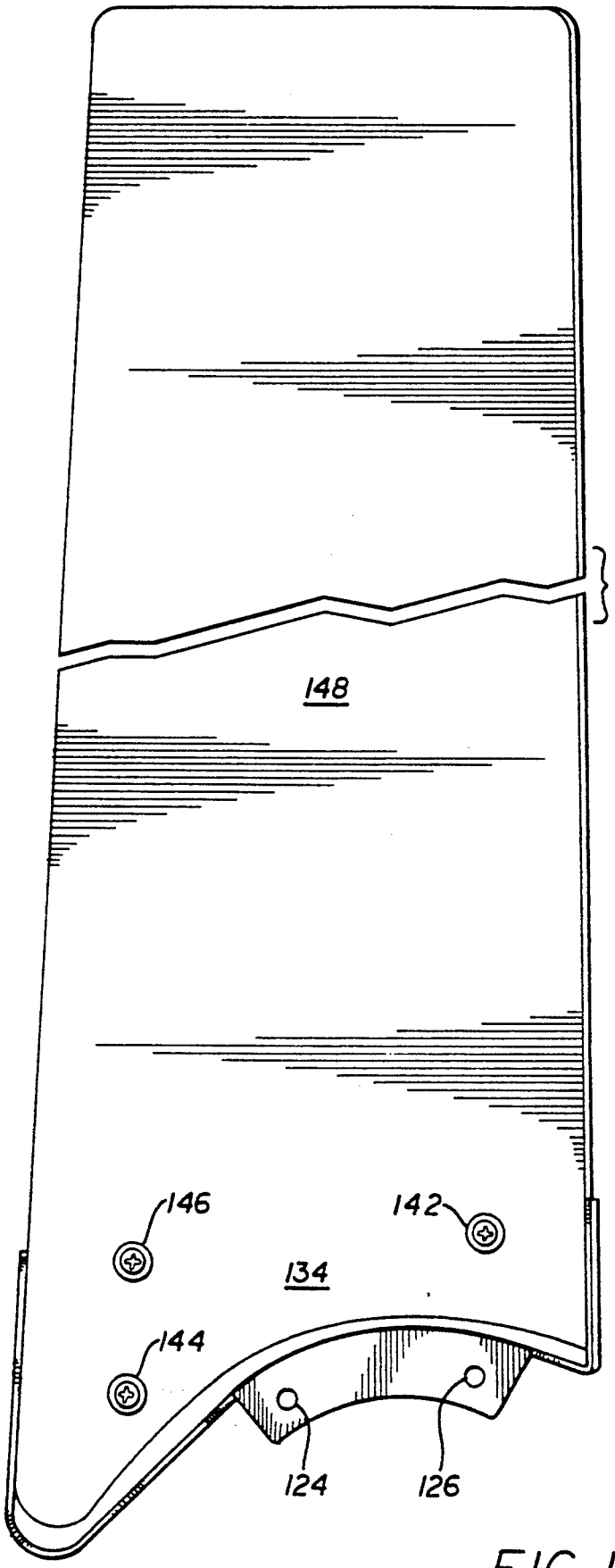
FIG. 10 is a top view of the blade iron of FIG. 6 with a fan blade affixed thereto.

It will now be recognized by those skilled in the art that the blade iron as provided in accordance with the principles of the present invention may be easily substituted for the blade irons detachably secured to rotors of ceiling fans currently in use. When such is done, a fan blade having the construction as shown in FIG. 10 may also be substituted for fan blades on ceiling fans currently in use. The end result would be a very streamlined swept wing appearance of the type shown in FIG. 1 as a results of the radial overlap of each trailing edge to next successive leading edge of the blade irons. Although such overlap can be any amount which is desired in accordance with any particular design, the overlap is greater than 45° but less than 90° such that the cumulative overlap for five blade irons is grater than 200°.

What is claimed is:

1. A ceiling fan comprising:

(A) a motor having a rotor defining a plurality of spaced apart pairs of openings;

(B) a blade iron removably attached to each pair of said openings;

(C) a fan blade removably attached to each blade iron;

each blade iron having (1) an arcuate web portion;

(2) a first flange extending inwardly from said web portion for attachment to said rotor;

(3) a second flange extending outwardly from said web portion for receiving said fan blade;

(D) said second outwardly extending flange having a leading edge and a trailing edge;

(E) said trailing edge of each said blade iron overlapping the leading edge of the next successive blade iron.

2. A ceiling fan as defined in claim 1 wherein said second outwardly extending flange includes an upstanding rim bordering three sides thereof for receiving and retaining said fan blade in place thereon.

3. A ceiling fan as defined in claim 2 wherein said outwardly extending flange includes a plurality of threaded posts extending therefrom in the same direction as said rim for receiving fasteners to retain said fan blade on said blade iron.

4. A ceiling fan as defined in claim 3 wherein said first and second flanges define planes which converge toward said leading edge.

5. A ceiling fan as defined in claim 4 wherein said web defines an arc such that when said first flanges are affixed to said rotor, said webs define a substantial circle while said second flanges define a tangentially extending surface terminating in said trailing edge of said blade iron.

6. A ceiling fan as defined in claim 5 wherein said trailing edge radially overlaps said leading edge of the next successive blade iron by an amount greater than 45° but less than 90°.

7. A ceiling fan as defined in claim 6 wherein said second outwardly extending flange defines a smooth and unobstructed surface when viewed from below in its installed position.

8. A ceiling fan as defined in claim 7 wherein each fan blade includes a root and a tip, said root being received and held in position upon said second flange and said blade tapering from said root towards said tip.

9. A ceiling fan as defined in claim 5 wherein said posts are formed integrally with said second outwardly extending flange and define, threaded re-entrant openings therein for receiving fasteners to secure said fan blades to said blade irons.

10. A ceiling fan as defined in claim 9 wherein each said blade iron includes three posts with two of said posts being disposed adjacent the trailing edge of said blade iron.

11. A ceiling fan as defined in claim 6 wherein the cumulative overlap of the trailing edge with respect to the leading edge is greater than 200°.

* * * * *